United States Patent [19]

Natesan et al.

[11] Patent Number: 4,470,848

[45] Date of Patent: Sep. 11, 1984

[54] OXIDATION SULFIDATION RESISTANCE OF FE-CR-NI ALLOYS

[75] Inventors: Ken Natesan, Naperville; David J. Baxter, Woodridge, both of Ill.

[73] Assignee: The United States of America as represented by the United States Department of Energy, Washington, D.C.

[21] Appl. No.: 517,474

[22] Filed: Jul. 26, 1983

[51] Int. Cl.[3] ..... C22C 38/14

[52] U.S. Cl. ..... 75/128 G; 75/128 Z; 420/584; 420/419; 420/442

[58] Field of Search ..... 75/128 G, 128 Z; 148/37, 419, 442, 35; 420/584, 583, 586; 220/DIG. 11

[56] References Cited

U.S. PATENT DOCUMENTS

| | | | |
|---|---|---|---|
| 2,157,060 | 5/1939 | Schafmeister | 75/128 Z |
| 2,174,025 | 9/1939 | Wise et al. | 75/128 G |
| 3,940,267 | 2/1976 | Mimino et al. | 75/128 G |

*Primary Examiner*—L. Dewayne Rutledge
*Assistant Examiner*—Debbie Yee
*Attorney, Agent, or Firm*—William Lohff; James W. Weinberger; Michael F. Esposito

[57] ABSTRACT

High temperature resistance of Fe-Cr-Ni alloy compositions to oxidative and/or sulfidative conditions is provided by the incorporation of about 1–8 wt. % of Zr or Nb and results in a two-phase composition having an alloy matrix as the first phase and a fine grained intermetallic composition as the second phase. The presence and location of the intermetallic composition between grains of the matrix provides mechanical strength, enhanced surface scale adhesion, and resistance to corrosive attack between grains of the alloy matrix at temperatures of 500°–1000° C.

6 Claims, 3 Drawing Figures

OXIDATION SULFIDATION RESISTANCE OF FE-CR-NI ALLOYS

CONTRACTUAL ORIGIN OF THE INVENTION

The U.S. Government has rights in this invention pursuant to Contract No. W-31-109-ENG-38 between the U.S. Department of Energy and the University of Chicago representing Argonne National Laboratory.

BACKGROUND OF THE INVENTION

This invention relates to improved chemical resistance in iron based alloys and more particularly to Fe-Cr-Ni alloy compositions containing a small amount of a metallic addition to improve chemical resistance at high temperatures.

Iron based alloys and particularly Fe-Cr-Ni alloys are construction materials for coal gasifiers, processing vessels and other equipment designed to operate at temperatures in the order of 500–1000° C. In many instances, corrosive gases containing oxygen and/or sulfur are present. Under conditions of oxidation and particularly sulfidation, this equipment often has limited periods of operation before repairs or replacements are required. In addition, it is often necessary to utilize substantial amounts of chromium in these alloys to achieve reasonable performance. Chromium is an expensive component and primarily obtained from sources outside the United States.

Accordingly, one object of this invention is an improvement in the oxidative and/or sulfidative resistance of iron based alloys. A second object of the invention is a reduction in the amount of chromium required in iron based alloys under oxidative and/or sulfidative conditions. Another object of the invention is an improvement in the chemical resistance of low-chromium iron-based alloys. These and other objects will become apparent from the following detailed description.

SUMMARY OF THE INVENTION

Briefly, the invention is directed to iron-based alloy compositions and particularly to Fe-Cr-Ni alloy compositions containing a small amount of Zr or Nb sufficient to provide improved chemical resistance at high temperatures (i.e., 500°–1000° C.) to oxidative and/or sulfidative conditions. Usually, the amount of Zr and Nb ranges up to about 8 wt.% of the composition. More particularly, the invention is directed to Fe-Cr-Ni alloy compositions containing Zr or Nb in small amounts and characterized by a first phase composed of an alloy matrix with a higher Cr content than the average composition and a fine grained intermetallic composition of Zr and/or Nb, Fe and Ni in the interfaces between grains of the matrix. In the formation of the alloy composition, precipitates (intermetallics) are formed containing Fe, Ni and Zr or Nb in the approximate ratio $(Fe, Ni)_{3\text{-}5}Zr$ (or Nb). The Cr tends to concentration in the alloy matrix representing the remaining volume. The resulting composition therefore has two phases and may be identified as a duplex composition.

Several advantages result from the use of Zr or Nb. The intermetallic particles induce grain refinement in the alloys. These particles form at the interfaces between grains of the alloy matrix and provide mechanical strength to the composition. The Cr tends to concentrate in the alloy matrix and provide a protective oxide scale of chromium oxide. In addition, the presence of Zr or Nb tends to promote enhanced surface scale adhesion with the alloy. In the absence of Zr or Nb, large voids form between the metal and the surface scale which lead to significant separation of the scale from the underlying metal.

DETAILED DESCRIPTION OF THE INVENTION

In the invention, Zr and Nb as additives are used in iron-based alloy compositions to improve their chemical resistance at high temperatures to oxidative and/or sulfidative conditions. In the past, it has been proposed to test a wide variety of elements in iron-based alloys or high Cr-Ni alloys. These have included Al, Mo, Mn, Si, Ti, Zr, Hf, V, Nb and Ta in very narrow composition ranges. Very preliminary screening resulted in the rejection of several. Some such as Si, Mn, Ta and V were rejected because of poor performance. After preliminary testing, further experiments with Zr were abandoned because it formed intermetallics and appeared to be one of the less promising of the elements. Hf was rejected because of its tendency to form carbides with high melting points. Nb was tested only in Ni-30 Cr. It was further speculated in earlier work that some additives might provide improvement only in alloys with Cr levels above about 25%.

In this invention, benefits provided by the addition of Zr or Nb to Fe-Cr-Ni alloy compositions are recognized with respect to their performance at temperatures in the order of 500–1000° C. and in corrosive atmospheres containing oxygen and/or sulfur. The useful Fe-Cr-Ni compositions contain Cr in the range of about 9–30 wt.%, Ni in the range of about 10–25 wt.%, and Fe as the predominant remaining component other than Zr or Nb. The amounts of Zr or Nb to provide the desired benefits range from about 1 wt.% to 8 wt.% with 1–6 and particularly 3–6 wt.% generally preferred. The resulting composition is characterized by a first phase of an alloy matrix with a chromium content higher than the average of the alloy composition and with a second phase of an intermetallic composition of Fe, Ni and Zr or Nb in the form of particles at the interfaces between grains of the alloy matrix.

Without the addition of Zr or Nb, voids appear at the interfaces and tend to expose the underlying metal to corrosive attack, weaken the mechanical strength of the alloy and weaken the adhesion of the protective scale of chromium oxide to the metallic surface.

In the formation of the alloy compositions containing Zr or Nb, precipitates of the intermetallics form and contain primarily Fe, Ni and Zr or Nb. The chromium generally remains in the alloy matrix thereby increasing its concentration. In this manner, the addition of Zr or Nb provides an enhanced benefit of Cr. From visual inspection of samples, it appears that an Fe-Cr-Ni composition with 12 wt.% Cr and 3 wt.% Zr performs similarly to an Fe-Cr-Ni composition containing 25 wt.% Cr and 0 wt.% Zr.

Figure 1:
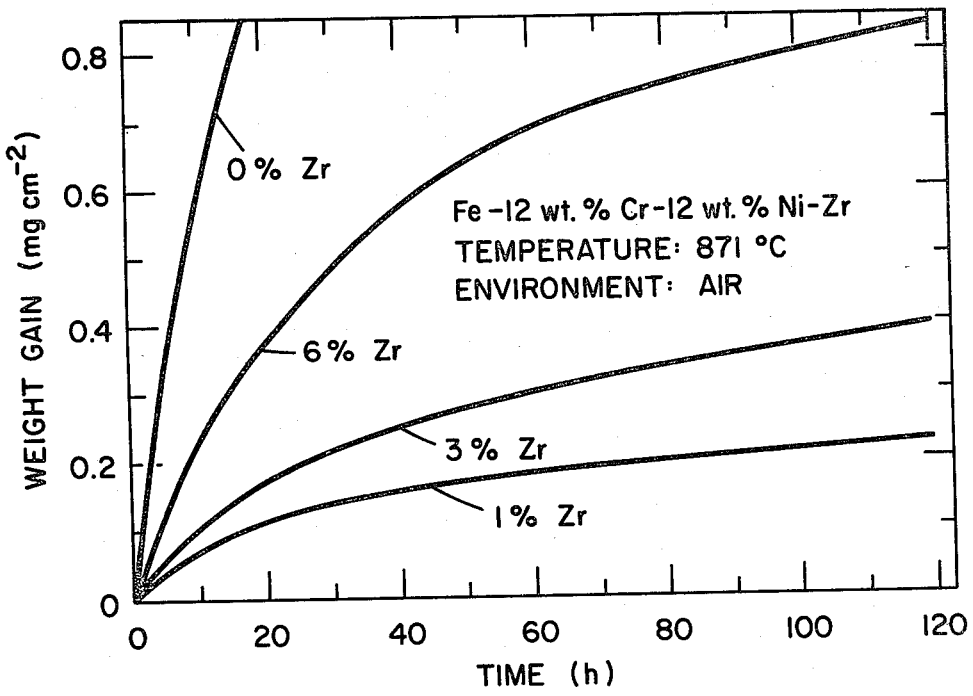
FIG. 1 is a graph of the oxidation rates for Fe-Cr-Ni alloy compositions containing 12 wt.% Cr and 0–6 wt.% Zr.
Figure 3:
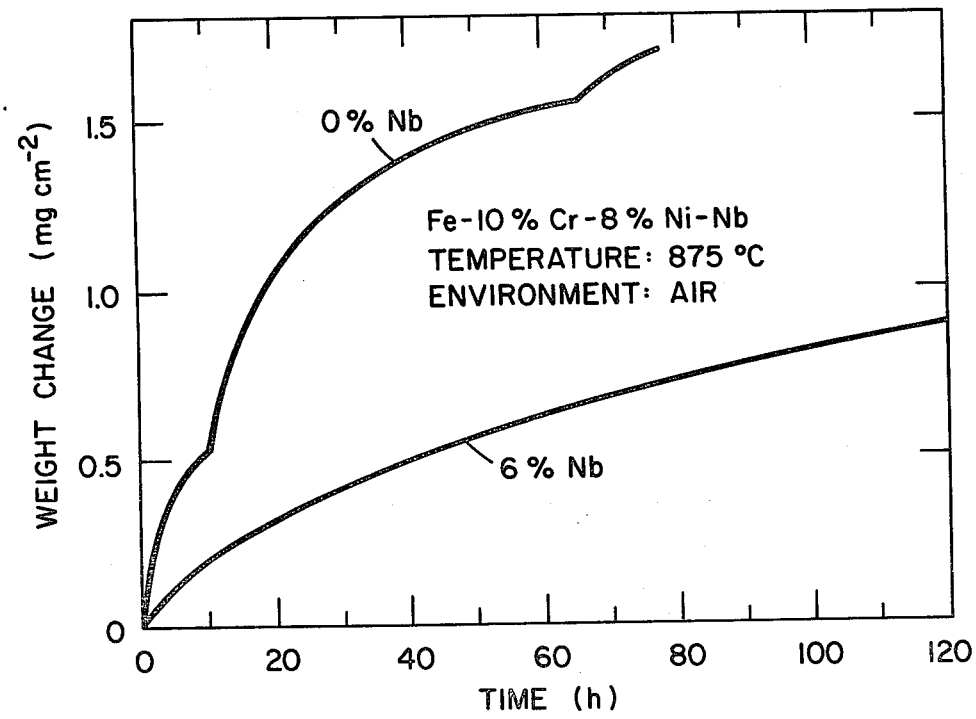
FIG. 3 is a graph of the oxidation rates for Fe-Cr-Ni compositions containing 10 wt.% Cr and 0 and 6 wt.% Nb.

Particularly for the alloy compositions with low Cr content, FIGS. 1 and 3 reveal that the oxidation rate increases so rapidly that the scale is not stabilized whereas the rates with Zr or Nb appear to follow a curve that would reach a relatively constant value.

In comparison with Fe-Cr-Ni compositions containing Al as an additive, the presence of Zr or Nb appears to provide an alloy composition with better high temperature strength and less of a tendency for the scale to be removed by spalling.

The following examples are provided for illustrative purposes and are not intended to be restrictive as to the scope of the invention:

EXAMPLES I–XVI

Eight Zr-containing and eight Nb-containing Fe-Cr-Ni alloys were arc-melted from high purity metal stock under a nonoxidizing atmosphere and cast in ingot form. The Zr containing alloy compositions are listed in Table I and are based on alloys with a Cr content of essentially 12 wt.% Cr and 25 wt.% Cr. As indicated, the content of Fe essentially represents the remainder of the compositions after Cr, Ni and Zr. The alloy compositions with Nb are listed in Table II. As indicated, the Cr content appears to vary with the Nb content and ranges from about 9–11 wt.% for one composition to 22–26 wt.% for the second composition. The ingots were cold rolled with intermediate annealing to 1.25-mm-thick sheets. Zirconium-free or Nb-free alloys were given the standard annealing treatment for austenitic Fe-Cr-Ni alloys (i.e., 1 hr. at 1050° C.) to remove the effects of a final 50% cold reduction and to homogenize the structures. Annealing at 1100° C. for up to 7 hr. was required to produce fine, relatively uniform distributions of intermetallics containing Fe, Ni and Zr/Nb in the alloys. Intermetallic particle sizes generally ranged between 4 and 8 μm, regardless of the Zr or Nb content in the alloys. In general, the intermetallic particles were found at the interfaces between grains of the alloy matrix. By microprobe analysis, the chemical compositions of the intermetallic particles were found to be approximately $Fe_4NiZr/Nb$ in the 10–13% Cr alloys and $Fe_{1.2-5}Ni_{3.5}Zr/Nb$ in the 25% Cr alloys. The volume fraction of the intermetallic material containing the Zr/Nb increased proportionally with increasing concentration of Zr/Nb in the alloy. The presence of the intermetallic particles resulted in grain refinement in all of the alloys.

Table III lists the matrix grain sizes and theoretical and actual matrix compositions for the alloys associated with the Zr additive. As indicated the grain size was reduced by increasing amounts of Zr from 40–50 μm to 6–10 μm for the alloy with 12 wt.% Cr and from 40–50 μm to 3–6 μm for the alloy with 25 wt.% Cr. The Cr content of the alloy matrix also appeared to change with increasing amounts of Zr with the largest increase of about 2.3 wt.% (14.3–12.0) being at the 6 wt.% level of Zr for the 12 wt.% Cr and about 3.5 wt.% (28.3–24.8) at the 6 wt.% level of Zr for the 25 wt.% Cr.

In the alloys free from Zr or Nb, those based on 25% Cr had fully austenitic matrices with equiaxed grains after the heat treatment. In the 10–13% Cr alloys free from Zr or Nb, matrices were composed of both austenite and ferrite (duplex structure) with equiaxed grains. In general, the presence of Zr or Nb in the intermetallic particles resulted in an increase in the Cr content of the alloy matrices. As a result, the structure of the alloy matrix of the 25% Cr alloys was duplex, austenite and ferrite. The structure of the alloy matrix in the 10–13% Cr alloys remained duplex.

Test specimens, approximately 13 by 10 by 0.8 mm in size with a 2 mm diameter drilled hole for suspension and ground with 240, 400 and 600 grit SiC paper, cleaned and dried, were prepared for testing. The test specimens were exposed to atmospheres of air. Test specimens were also exposed to mixtures of CO, $CO_2$, $CH_4$, $H_2S$, and $H_2$ at various oxygen and sulfur partial pressures as listed in Table IV.

Figure 2:
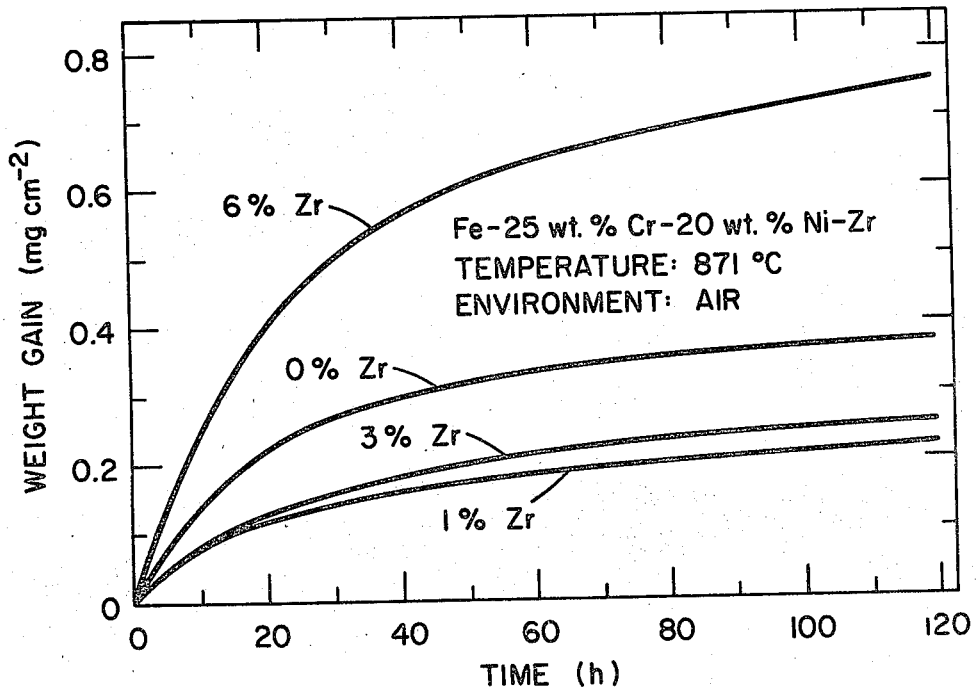
FIG. 2 is a graph of the oxidation rates for Fe-Cr-Ni compositions containing 25 wt.% Cr and 0–6 wt.% Zr.

Results from exposure to air are shown in FIGS. 1, 2, and 3 for the 12 and 25 wt.% Cr alloy compositions containing 0–6 wt.% Zr and for the 10 wt.% Cr alloy compositions containing 0 and 6 wt.% Nb. As indicated by the curves for 0 wt.% Zr and Nb for the 12 wt.% Cr and 10 wt.% Cr, respectively, the oxidation rates at temperatures in the order of 875° C. appear excessive and were improved by the addition of Zr or Nb.

From tests and visible inspection of the samples exposed to air and the above mixtures covering a range of partial pressures of oxygen and sulfur, the following results may also be reported.

In air, additions of Zr or Nb influence the oxidation behavior of alloys containing 10–13 wt.% Cr and alloys containing 22–26 wt.% Cr. On the 22–26 wt.% Cr alloys, protective Cr oxide scales were formed. The rate of scale formation during the first 50 hours of oxidation at 871° C. was dependent upon the Zr concentration in the alloy, but the rate of scale growth thereafter was independent of the Zr content as the protective scale slowly thickened. Very similar behavior was observed for the 22–26 wt.% Cr alloys containing Nb.

In air, the pure ternary (Fe-Cr-Ni) alloy containing 10–13 wt.% Cr was unable to maintain a protective Cr oxide scale at 871° C. In the absence of Zr or Nb, the 10–13 wt.% alloy formed a scale containing large quantities of Fe. The rate of scale growth and thus the rate of consumption of metal was relatively high. In addition, scale spallation occurred under isothermal conditions. When either Zr or Nb was present, the scale formed was Cr oxide which was protective. The rate of growth of the Cr oxide on the 10–13 wt.% Cr alloys was similar to the rate of growth of the oxide on the 22–26 wt.% Cr alloys.

The addition of Zr or Nb to an Fe-Cr-Ni alloy containing 10–13 wt.% Cr promoted growth of a protective surface oxide scale, the resulting kinetics being closely similar to the oxidation kinetics of an alloy containing 22–26 wt.% Cr. In addition, the presence of Zr or Nb in the 10–13 wt.% or 22–26 wt.% Cr alloys promoted improved adhesion of the surface oxide scales to the alloy substrates.

The behavior of the 22–26 wt.% Cr alloys with addition of Zr or Nb in a sulphur-free, low oxygen partial pressure environment was similar to the behavior of the alloys in air. Additions of Zr or Nb promoted formation of a protective Cr oxide scale on the 10–13 wt.% Cr alloys, but more than 3 wt.% of Zr or Nb was required for the protective scale to be formed. The additions of Zr or Nb enhanced scale adhesion in both 10–13 wt % and 22–26 wt.% Cr alloys.

Further tests were carried out in oxygen and sulfur environments at low partial pressures. Depending on the precise oxygen and sulphur partial pressures in a given environment and the temperature of the environment, an alloy formed either a protective, slow-growing oxide scale or a thick, fast-growing sulfide scale. Internal sulfidation of the alloy, and thus even more rapid alloy degradation, usually accompanied the formation of the surface sulfide scales. For a given alloy, a boundary that divided protective oxidation and rapid sulfidation reaction processes could be defined. The boundary was normally found to be located at an oxygen partial pressure about 3 to 5 orders of magnitude (in atmospheres) greater than the oxygen partial pressure for thermodynamic equilibrium between Cr oxide ($Cr_2O_3$) and Cr sulfide ("CrS").

For tests carried out at 650, 875 and 1000° C., additions of Zr or Nb promoted the oxide formation reaction (and thus suppressed the sulfide formation reaction), with the result that the oxide/sulfide "threshold" boundary was moved to a lower oxygen partial pressure. For example, the addition of 6 wt.% Zr or Nb to the 22-26 wt.% Cr alloy resulted in a shifting of the threshold boundary by one order of magnitude in oxygen pressure (in atm.) at a test temperature of 875° C. Enhanced oxide formation in the early stages of the corrosion process and a doping action by Zr or Nb in the oxide scales promoted the improved behavior.

As demonstrated by the above disclosure, the invention provides a useful alloy composition with beneficial results at high temperatures in the range of 500-1000° C. In particular, vessels and other equipment made of these alloy compositions would be expected to have enhanced performance at those temperatures.

The foregoing description of embodiments of the invention has been presented for purposes of illustration and description. It is not intended to be exhaustive or to limit the invention to the precise form disclosed. Other modifications and variations are possible in light of the above teaching.

TABLE I

Composition of Alloys with 12-25 wt. % Cr and 0-6 wt. % Zr

| Nominal Composition | Concentration of Elements (wt %) | | | | | |
|---|---|---|---|---|---|---|
| | Ni | Cr | Zr | Mn | Si | Fe |
| 12Cr—12Ni | 12.13 | 11.90 | — | 0.03 | <0.1 | Balance |
| —1Zr | 12.01 | 12.00 | 0.89 | 0.05 | ↓ | ↓ |
| —3Zr | 11.99 | 12.00 | 2.76 | 0.10 | ↓ | ↓ |
| —6Zr | 12.13 | 11.98 | 6.25 | 0.05 | ↓ | ↓ |
| 25Cr—20 Ni | 20.01 | 24.87 | — | 0.05 | ↓ | ↓ |
| —1Zr | 19.98 | 24.96 | 0.77 | 0.05 | ↓ | ↓ |
| —3Zr | 19.78 | 24.83 | 3.14 | 0.05 | ↓ | ↓ |
| —6Zr | 20.18 | 24.82 | 5.95 | 0.03 | ↓ | ↓ |

TABLE II

Composition of Alloys with 9-26 wt. % Cr and 0-6 wt. % Nb

| Nominal Composition | Concentration of Elements (wt %) | | | | | |
|---|---|---|---|---|---|---|
| | Fe | Cr | Ni | Mn | Si | Nb |
| 10Cr—8Ni | Balance | 10.97 | 8.06 | 0.15 | 0.23 | — |
| 1Nb | ↓ | 10.90 | 7.90 | 0.15 | 0.21 | 1.13 |
| 3Nb | ↓ | 10.11 | 8.07 | 0.15 | 0.17 | 3.21 |
| 6Nb | ↓ | 8.94 | 8.18 | 0.15 | 0.25 | 6.67 |
| 25Cr—20Ni | ↓ | 24.65 | 19.80 | 0.14 | 0.38 | — |
| 1Nb | ↓ | 25.29 | 19.87 | 0.17 | 0.23 | 0.98 |
| 3Nb | ↓ | 24.01 | 19.99 | 0.14 | 0.27 | 3.28 |

TABLE II-continued

Composition of Alloys with 9-26 wt. % Cr and 0-6 wt. % Nb

| Nominal Composition | Concentration of Elements (wt %) | | | | | |
|---|---|---|---|---|---|---|
| | Fe | Cr | Ni | Mn | Si | Nb |
| 6Nb | ↓ | 22.52 | 20.55 | 0.15 | 0.42 | 6.75 |

TABLE III

Alloy Matrix Compositions and Grain Sizes For Zr Containing Alloys

| Alloy Nominal Composition | Matrix Grain Size (μm) | Theoretical Matrix Composition (wt %) | | | Actual Matrix Composition (wt %) | | |
|---|---|---|---|---|---|---|---|
| | | Cr | Ni | Fe | Cr | Ni | Fe |
| 12Cr—12Ni | 40-50 | 12.0 | 12.0 | 76.0 | 11.9 | 12.1 | 74.7 |
| —1Zr | 25—30 | 12.2 | 11.8 | 75.9 | 12.1 | 11.3 | 76.5 |
| —3Zr | 12-18 | 12.9 | 11.4 | 76.3 | 13.6 | 10.4 | 76.0 |
| —6Zr | 6-10 | 14.2 | 11.3 | 74.0 | 14.3 | 10.4 | 75.3 |
| 25Cr—20Ni | 40-50 | | | | 24.9 | 20.0 | 54.1 |
| —1Zr | 10-20 | 25.4 | 19.2 | 55.2 | 25.6 | 19.2 | 55.2 |
| —3Zr | 6-12 | 28.0 | 14.7 | 57.6 | 26.2 | 16.0 | 57.5 |
| —6Zr | 3-6 | 33.3 | 8.7 | 58.0 | 28.3 | 13.6 | 58.1 |

TABLE IV

Gas Compositions

| Gas Mix Number | Gas Composition (Vol. %) | | | | |
|---|---|---|---|---|---|
| | CO | $CO_2$ | $CH_4$ | $H_2S$ | $H_2$ |
| 1 | 5.25 | 10.50 | 1.75 | 0 | 82.50 |
| 2 | 16.5 | 33.0 | 5.5 | 0.711 | 44.289 |
| 3 | 16.5 | 33.0 | 5.5 | 0.284 | 44.716 |
| 4 | 1.8 | 3.6 | 0.6 | 0.171 | 93.829 |
| 5 | 1.8 | 3.6 | 0.6 | 0.015 | 93.985 |
| 6 | 6.0 | 12.0 | 2.0 | 0.515 | 79.485 |
| 7 | 6.0 | 12.0 | 2.0 | 0.135 | 79.865 |
| 8 | 16.5 | 33.0 | 5.5 | 0.078 | 44.922 |

The embodiments of the invention in which an exclusive property or privilege is claimed are defined as follows:

1. An iron-based alloy composition useful at high temperatures and consisting essentially of a mixture of Fe-Cr-Ni and about 3-6 wt.% of a metallic additive selected from the group consisting of zirconium, niobium and mixtures thereof, wherein the composition is characterized by a first phase composed of an alloy matrix containing Cr in a higher concentration than the average for the composition and a carbide-free fine-grained intermetallic of the metallic additive as a second phase dispersed between portions of the first phase.

2. The alloy composition of claim 1 wherein said additive is zirconium.

3. The alloy composition of claim 1 wherein said additive is niobium.

4. The alloy composition of claim: 1 wherein said mixture of Fe-Cr-Ni contains amounts of chromium in the range of about 10-30 wt.% and nickel in the range of about 10-25 wt.%.

5. The alloy composition of claim 4 wherein said chromium amount is below about 15 wt.%.

6. A process-vessel for use at temperatures in the order of 500-1000°C. and constructed of the alloy composition of claim 1.

* * * * *